US006105606A

United States Patent [19]

Jackson

[11] Patent Number: 6,105,606

[45] Date of Patent: Aug. 22, 2000

[54] CHEMICAL CABINET EMPLOYING AIR FLOW BAFFLES

[75] Inventor: Robert M. Jackson, Burnet, Tex.

[73] Assignee: Advanced Delivery & Chemical Systems, Ltd., Austin, Tex.

[21] Appl. No.: 09/141,865

[22] Filed: Aug. 28, 1998

[51] Int. Cl.[7] ..... F24F 3/16

[52] U.S. Cl. ..... 137/376; 137/1; 137/343; 137/356; 312/31; 454/49; 454/237; 454/250; 141/93

[58] Field of Search ..... 137/1, 343, 356, 137/357, 360, 376, 312, 314; 312/31, 31.1, 35, 72, 209, 228, 228.1; 454/49, 237, 250; 141/86, 88, 93

[56] References Cited

U.S. PATENT DOCUMENTS

| | | | |
|---|---|---|---|
| 1,002,407 | 9/1911 | Kleinschmidt | 454/237 |
| 1,048,360 | 12/1912 | Sievert | 454/250 |
| 1,749,343 | 3/1930 | Hersh | 454/250 |
| 2,169,109 | 8/1939 | Muller | 454/49 |
| 2,227,990 | 1/1941 | Zelt | 454/237 |
| 2,364,144 | 12/1944 | Hunsaker | 312/31 |
| 2,561,517 | 7/1951 | Ladge | 312/31 |
| 4,257,445 | 3/1981 | Cook et al. | 137/360 |
| 4,625,627 | 12/1986 | Livanos et al. | 454/237 |
| 5,465,766 | 11/1995 | Siegele et al. | 141/198 |
| 5,562,132 | 10/1996 | Siegele et al. . | |
| 5,590,695 | 1/1997 | Siegele et al. . | |
| 5,607,002 | 3/1997 | Siegele et al. . | |
| 5,711,354 | 1/1998 | Siegele et al. . | |

*Primary Examiner*—J. Casimer Jacyna
*Attorney, Agent, or Firm*—O'Keefe, Egan & Peterman

[57] ABSTRACT

This invention concerns a cabinet for chemical canister storage and dispensing. More particularly, this invention concerns a cabinet structure comprising: walls connected to a base and a top to provide an enclosed structure; wherein at least one wall has at least one vent opening on the lower portion thereof; wherein an upper portion of the cabinet has a exhaust outlet hole; wherein one or more baffles are positioned within the cabinet structure to direct a flow of air over fittings of a canister, a cabinet manifold, or both as the air moves from the at least one vent opening to the exhaust outlet hole.

13 Claims, 13 Drawing Sheets

CHEMICAL CABINET EMPLOYING AIR FLOW BAFFLES

BACKGROUND OF INVENTION

This invention generally pertains to a cabinet for housing canisters of chemicals.

Cabinets for housing canisters of chemicals are well known. Many of these cabinets include valves and weldments which handle the chemicals during dispensing of the chemicals. Likewise, the canisters often have weldments and/or valves attached thereto. Previous cabinets had holes at the base for in-flow of air and an exhaust port out the top. There are continued efforts to improve these cabinets.

SUMMARY OF INVENTION

The present inventor has found that prior cabinets could be rendered safer by channeling the in-flow of air over weldments and valves, which are the most likely places where leaks in the system might occur. If the air flow were directed over these points, any leaks would be more quickly evaporated and pulled into the exhaust, rather than for example dripping and collecting at the base of the cabinet. This invention provides a solution to these and other disadvantages and problems of the prior chemical cabinets.

In one broad respect, this invention is a cabinet structure comprising: walls connected to a base and a top to provide an enclosed structure; wherein at least one wall has at least one vent opening on the lower portion thereof; wherein an upper portion of the cabinet has a exhaust outlet hole; wherein one or more baffles are positioned within the cabinet structure to direct a flow of air over fittings of a canister, a cabinet manifold, or both as the air moves from the at least one vent opening to the exhaust outlet hole.

In another broad respect, this invention is a cabinet useful for holding a canister, comprising: an enclosure adapted to house a canister that has fittings attached thereto, one or more baffles attached to the inside of the enclosure, wherein the enclosure includes at least one vent opening on the lower portion of the enclosure and at least one exhaust hole on the upper portion of the enclosure; wherein the one or more baffles are adapted to direct a flow of air that enters the enclosure through at least one vent opening over the fittings of the canister when the canister is positioned for normal use within the enclosure, or over a valve manifold in the enclosure, or both.

In another broad respect, this invention is a method of increasing the flow of gas through at least a portion of a chemical supply cabinet, comprising: providing a cabinet structure comprising: rectangular walls connected to a base and a top to provide an enclosed structure; wherein at least one wall has at least one vent opening on the lower portion thereof; wherein either the top or a wall includes an exhaust outlet hole; providing one or more baffles that are positioned within the cabinet structure to direct a flow of air over fittings of a canister, a cabinet manifold, or both as the air moves from the at least one vent opening to the exhaust outlet hole.

Advantageously, the present invention provides a cabinet structure in which air flow is channel past the fittings of a canister to thereby increase flow velocity over the fittings. This provides enhanced safety since any liquid in the area of the fittings is more rapidly evacuated from the cabinet than has been previously accomplished. Furthermore, use of baffles provides a simple and inexpensive mechanism by which increase flow is accomplished. It is envisioned that baffles can be added during initial construction of a cabinet. Alternatively, the baffles may be added as a retrofit to an existing cabinet.

DETAILED DESCRIPTION OF THE INVENTION

A general, non-limiting description of metallic canisters, chemical refill system, operating procedures, components, starting manifold system, and so forth, which may be used in the cabinet of this invention is set forth in U.S. Pat. Nos. 5,465,766; 5,562,132; 5,590,695; 5,607,002; and 5,711,354, all of which are incorporated herein by reference. It is envisioned that other manifolds, canisters, refill systems and so forth can be employed in the practice of this invention. The particular type and structure of the manifolds, canisters, refill systems, and the like is not critical in the practice of this invention.

Figure 1:
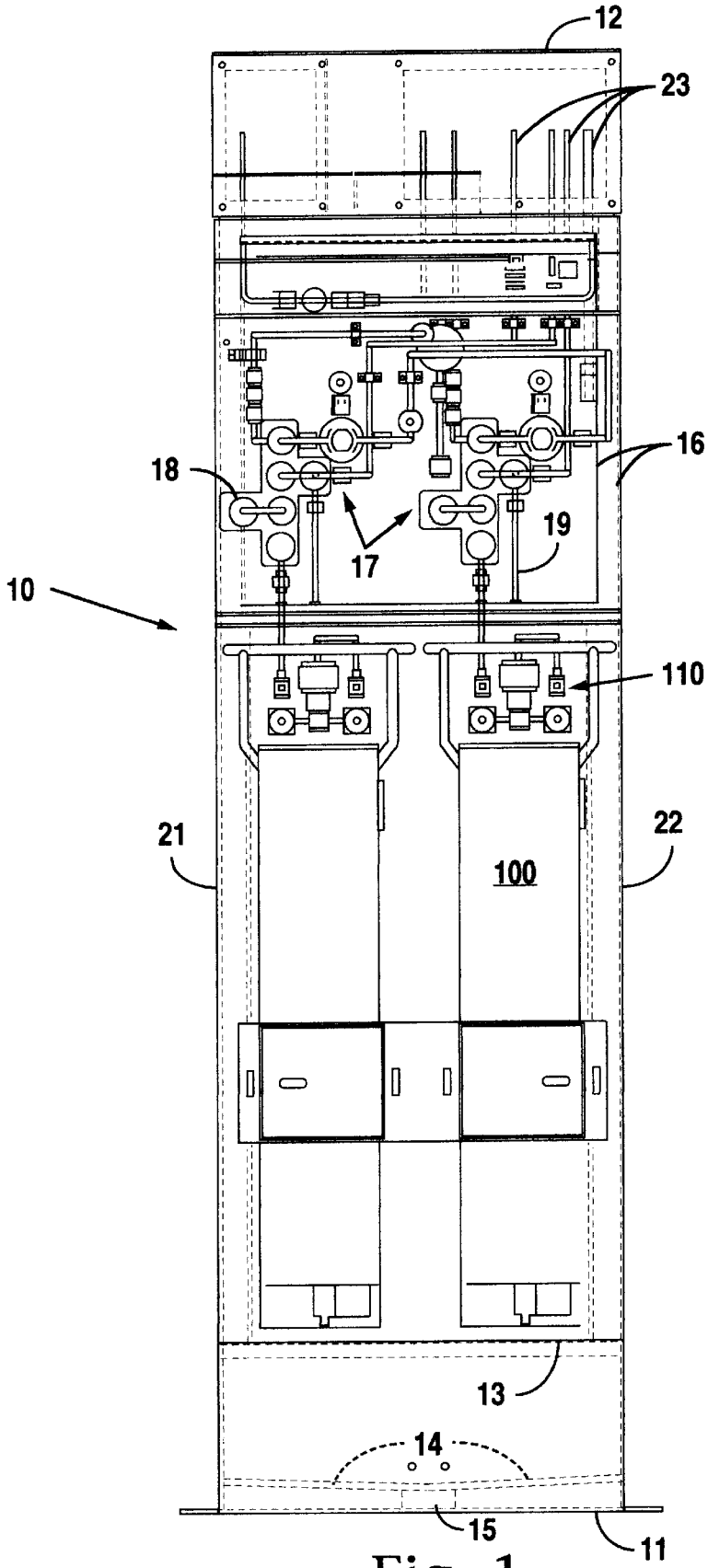
FIG. 1 depicts a front view of a cabinet of this invention.
Figure 2:
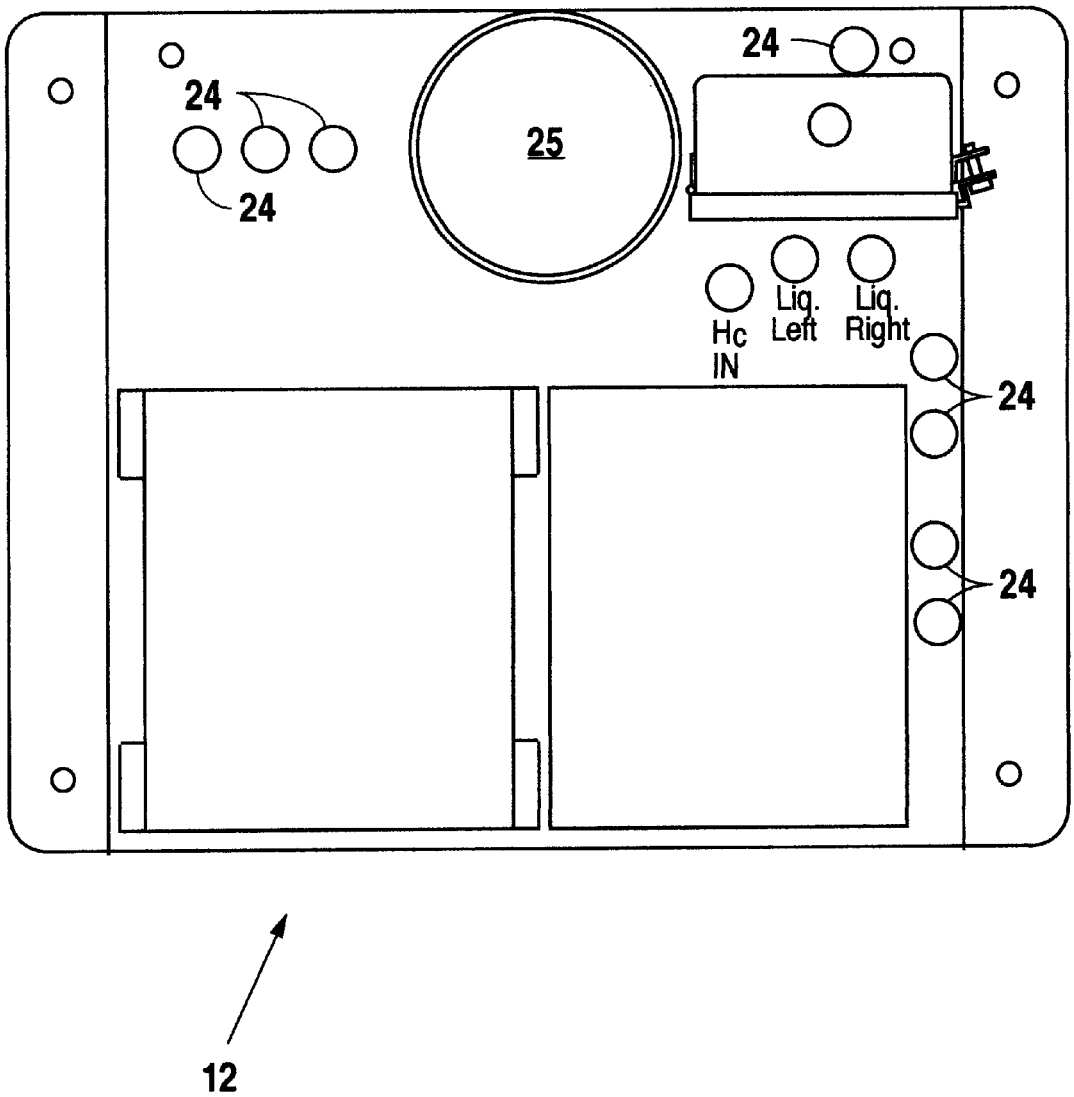
FIG. 2 depicts the top of the cabinet of this invention.
Figure 3:
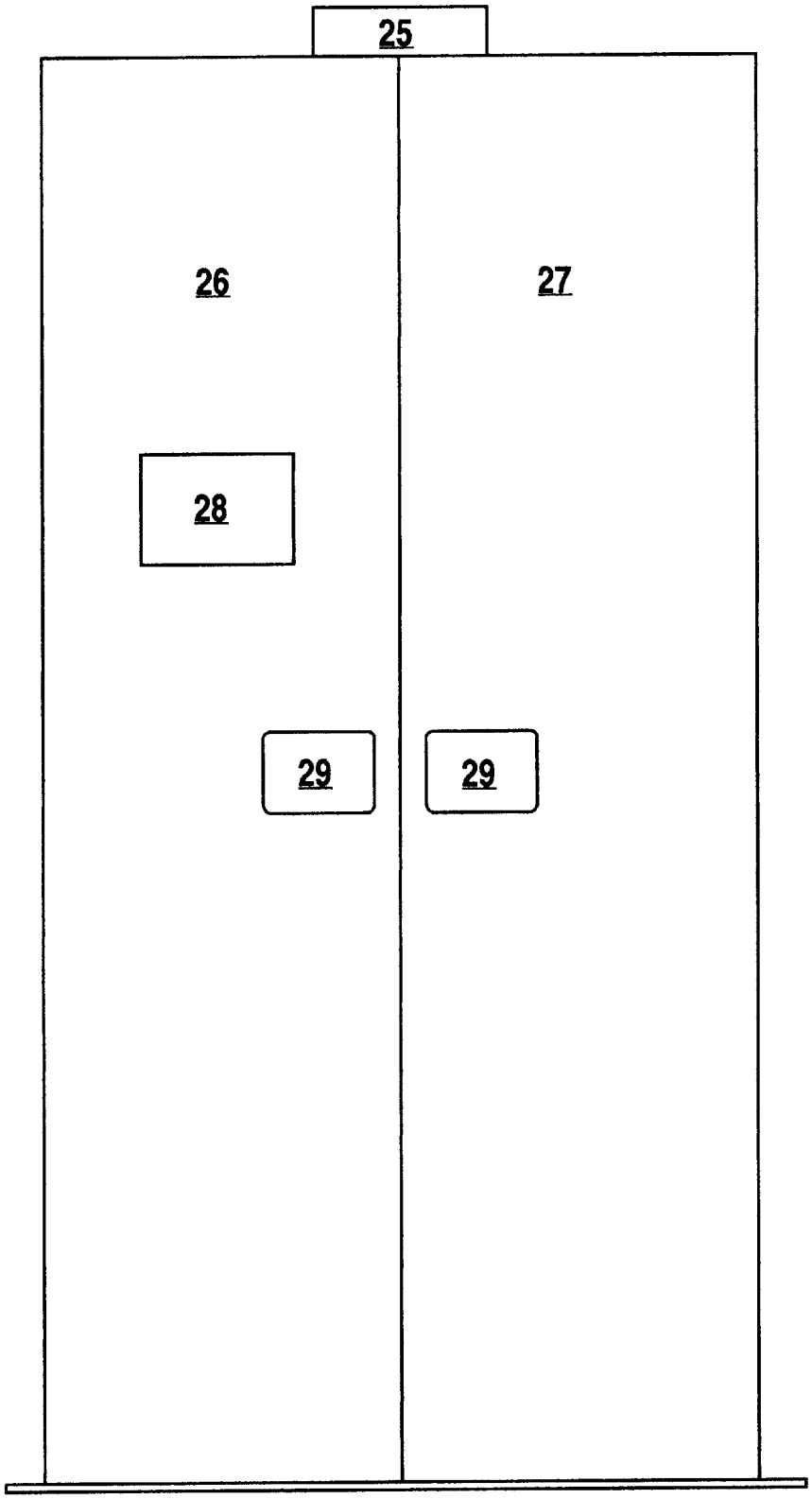
FIG. 3 depicts a front view of the cabinet with doors closed and the interior not being shown.

A representative cabinet of this invention is shown in FIG. 1. The cabinet in FIG. 1 includes a rectangular walls connected to a base and a top to provide an enclosed structure. At least one wall of the cabinet has at least one vent opening on the lower portion thereof (i.e., lower half). The top typically includes an exhaust outlet hole, but the exhaust may also be expelled through one or more holes in any wall, preferably in the upper half of the cabinet. One or more baffles may be positioned within the cabinet structure to direct a flow of air over fittings of a canister, a cabinet manifold, or both as the air moves from the at least one vent opening to the exhaust outlet hole. More particularly, cabinet 10 is adapted to house one or more canisters 100 that include weldments and fittings 110. As shown in FIG. 1, the cabinet 10 includes base 11 and top 12 which includes a exhaust hole (not shown). The cabinet has a grating 13, and inclined surfaces 14 leading to a trough 15. Darkened lines 16 depict the baffles which direct air from vent opening (not shown) to exhaust (not shown). Included in cabinet 10 are valve manifolds 17 by which air is directed by the baffles. The manifolds include valves 18 and tubing 19. The cabinet 10 may be made up of four walls. In FIG. 1, one wall immediately faces the viewer, one wall is positioned behind the canisters 100, one wall lies in the plane of edge 21 and perpendicular to the plane of the drawing, and one wall lies in the plane of edge 22 and perpendicular to the plane of the drawing. Tubing 23 leads out of the cabinet 10 through holes 24 in the top as shown in FIG. 2. FIG. 2 also depicts exhaust hole 25. FIG. 3 shows doors 26 and 27, cut-out for touch screen display 28, door handle areas 29.

As shown in FIGS. 4*a*, 4*b*, 4*c*, and 4*d* the baffles include fitting holes 30 which fit over the fittings of the canisters. The decrease in area through which air may flow serves to increase the flow rate of air over the canister fittings.

Figure 4A:
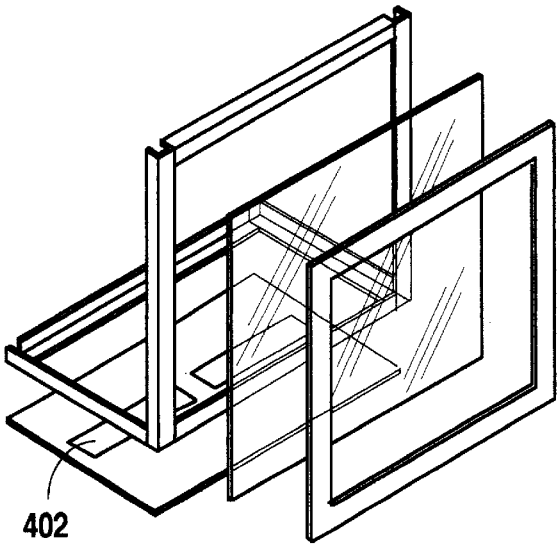
FIGS. 4*a*, 4*b*, 4*c*, and 4*d* depict exploded, front, front, and top views, respectively of the baffles employed in this invention.
Figure 4B:
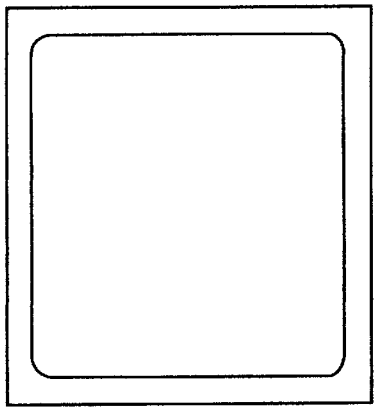
Figure 4C:
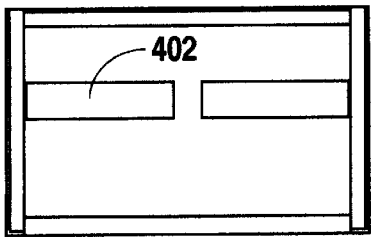
Figure 4D:
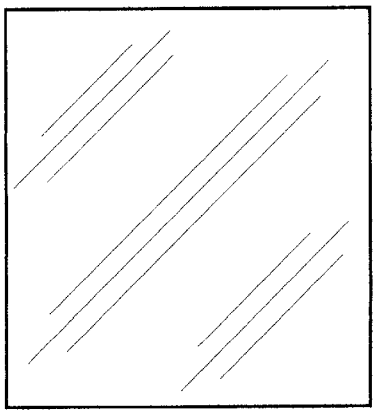

In FIG. 4*a* there is shown one embodiment of a baffling system 400 which may be used in the cabinet of this invention such as is depicted in FIG. 1. The system 400 includes a primary baffle plate 401. The plate 400 may include one or more holes 401. A hole 401 may be cut or bored from the material used to make the plate 400. However, it should be appreciated that the plate need not be monolithic, and instead may be assembled from two or more segments. A hole 401 preferably is positioned on the plate 400, and is of such dimensions, such tat fittings of a given canister (such as depicted in FIG. 1) may pass through hole 401. In this way, the plate 400 may be fitted over a canister so that gas, which is moving through the hole from the canister-side of the plate 400, is directed over the fittings. Thus, the holes are adapted to direct flow of gas over the fittings. It should be appreciated that while the plate 400 in FIG. 4*a* shows two holes 401, a single hole 401 can be alternatively employed if only one canister is housed in the cabinet, or three or more holes 401 may be included if there are multiple canisters.

The plate 40 has dimensions adapted to provide a seal against the walls of the cabinet, with or without the assistance of framing (e.g., frame 410) that serves to support or anchor the plate 400. The plate 400 may alternatively be configured with flaps so that the plate may be fastened directly to the walls rather than to the frame. The plate may be fastened using any fastener, such as bolts, rivets, tape, appropriate adhesive, and the like, or may be positioned in appropriately configured grooves or the like in the walls.

The system 400 may also include one or more vertical panels 420 positioned to channel gas flow from the holes 401 over the length of the fittings of the canister. In this manner a higher flow rate of gas may be maintained over the entire length of the fittings.

The plate 401 and panels 420 may be made of the same or different material. The materials used to fabricate these components of a system 400 may be metal such as stainless steel, polymeric composition such as plexiglass, glass, and the like. The materials may be the same type as the cabinet, or may be different. Typically, the material is a polymer. In general it is desirable for the material to be resistant to corrosion from the chemicals stored in the canister.

One embodiment of the system that may be included in the cabinet 101 of FIG. 1 is illustrated in FIGS. 36 and 37 of U.S. Pat. No. 5,711,354, incorporated herein by reference.

A cabinet used in the practice of this invention may be constructed to render it suitable for use in hazardous, explosive environments. In general, this is accomplished by isolating all electronic components in areas that are blanketed with an inert gas. In this way, a spark emanating from an electronic component will be in an environment having essentially no oxygen, which significantly reduces the likelihood of an explosion due to vapors that may be present in the cabinet. One non-limiting, representative embodiment of this cabinet is depicted in FIGS. 5A and 5B.

Figure 5A:
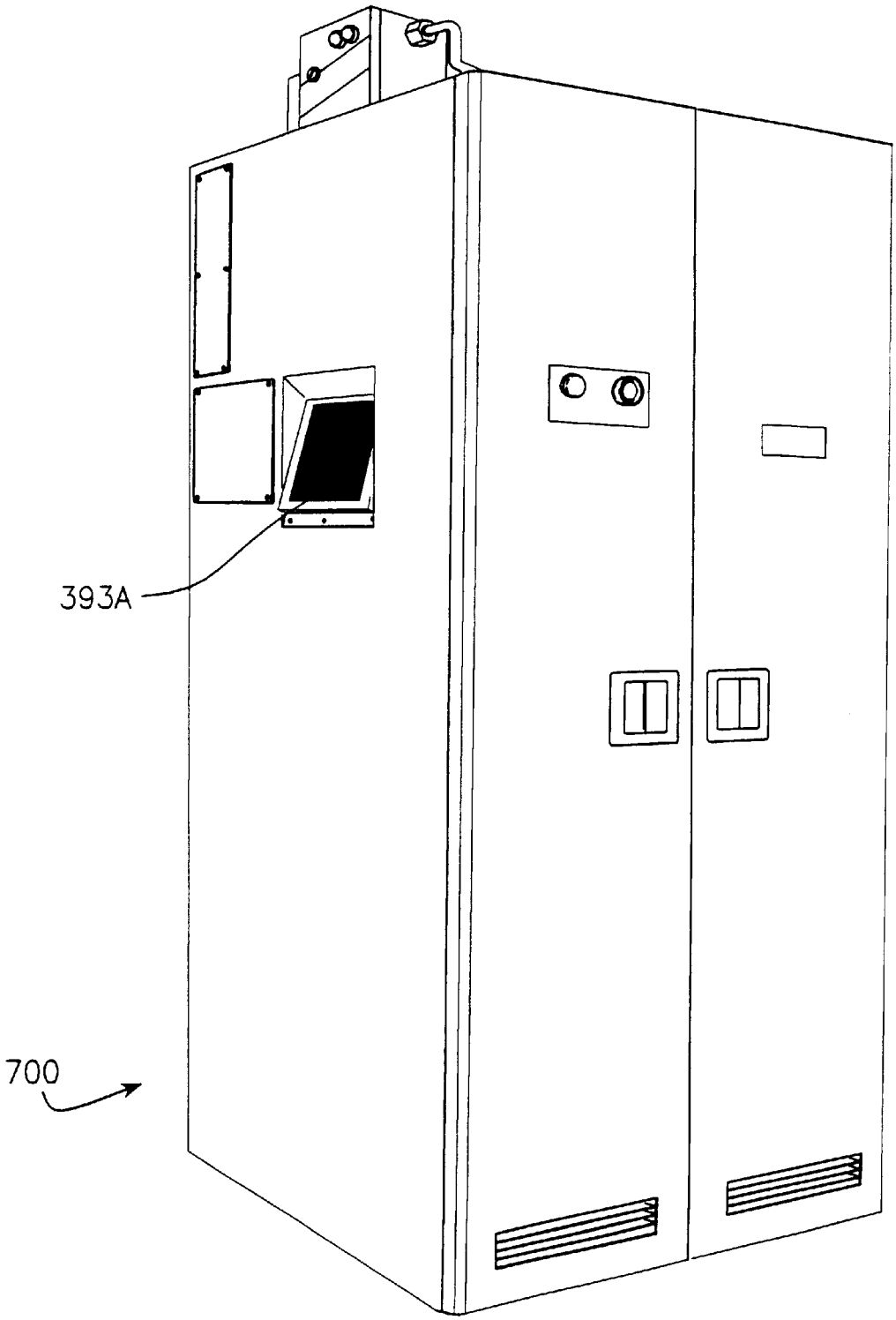
FIGS. 5*a* and 5*b* depict illustrate a cabinet of this invention that may be constructed to render it suitable for use in hazardous, explosive environments by isolating all electronic components in areas that are blanketed with an inert gas.
Figure 5B:
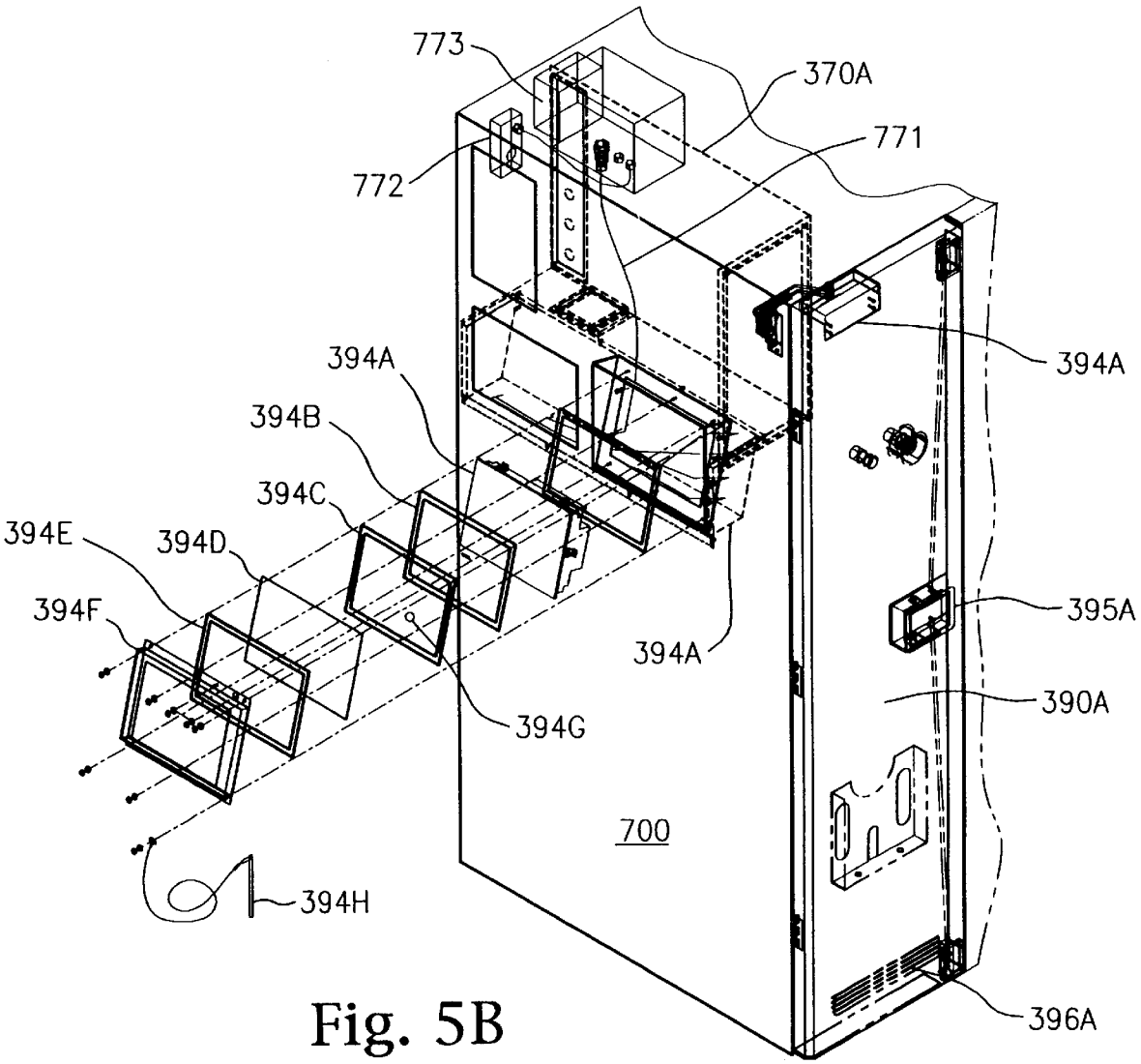

In FIGS. 5A and 5B, the numbers shown correspond to the components described above with respect to FIG. 3, with the proviso that in FIGS. 5A and 5B the numbers are followed with the letter "A". It is seen that in FIGS. 5A and 5B, the control box 370A and touch screen 393A have been isolated in the cabinet 700. The control box 370A may include electronic instrumentation (not shown) such as the process control instrumentation. During use the housings for the control box 370A and 393A are blanketed in an inert gas, which may be supplied by one or more purge lines 771. The one or more purge lines 771 may be connected to the housing for touch screen 393A. Additional conduits may be employed to allow inert gas to flow to the control box, directly, that is not connected to the purge line 771. In this way, a single line may be employed to provide a inert gas blanket over both the touch screen and the control box. One or more pressure relief valves 772 may be used to provide initial purge and to vent excess inert gas from the housings used for the control box and the touch screen. A purge control unit 773 may be included which serves to time the initial high pressure purge, and to monitor and meter inert gas to the isolated components. Conventional purge controllers may be employed such as is available from Expo Safety Systems. A door 390A may include a door lock 395A and vents 396A.

As shown in FIG. 5B, the touch screen 393A may be encased in a housing depicted by phantom lines 394A. To fully isolate the touch screen, additional components may be employed such as use of a plastic window (e.g., an electroconductive polycarbonate sheet) 394D that is held in place by gasket material 384B, plastic (e.g., acrylic) spacer 384C having holes for purge gas feed, touch screen window gasket material 394E, and purge enclosure frame 394F. When the touch screen is further isolated in this representative fashion, the touch screen may be accessed by use, for example, of a steel ball 394G which is manipulated through use of magnetic wand and lanyard 394H.

Figure 6:
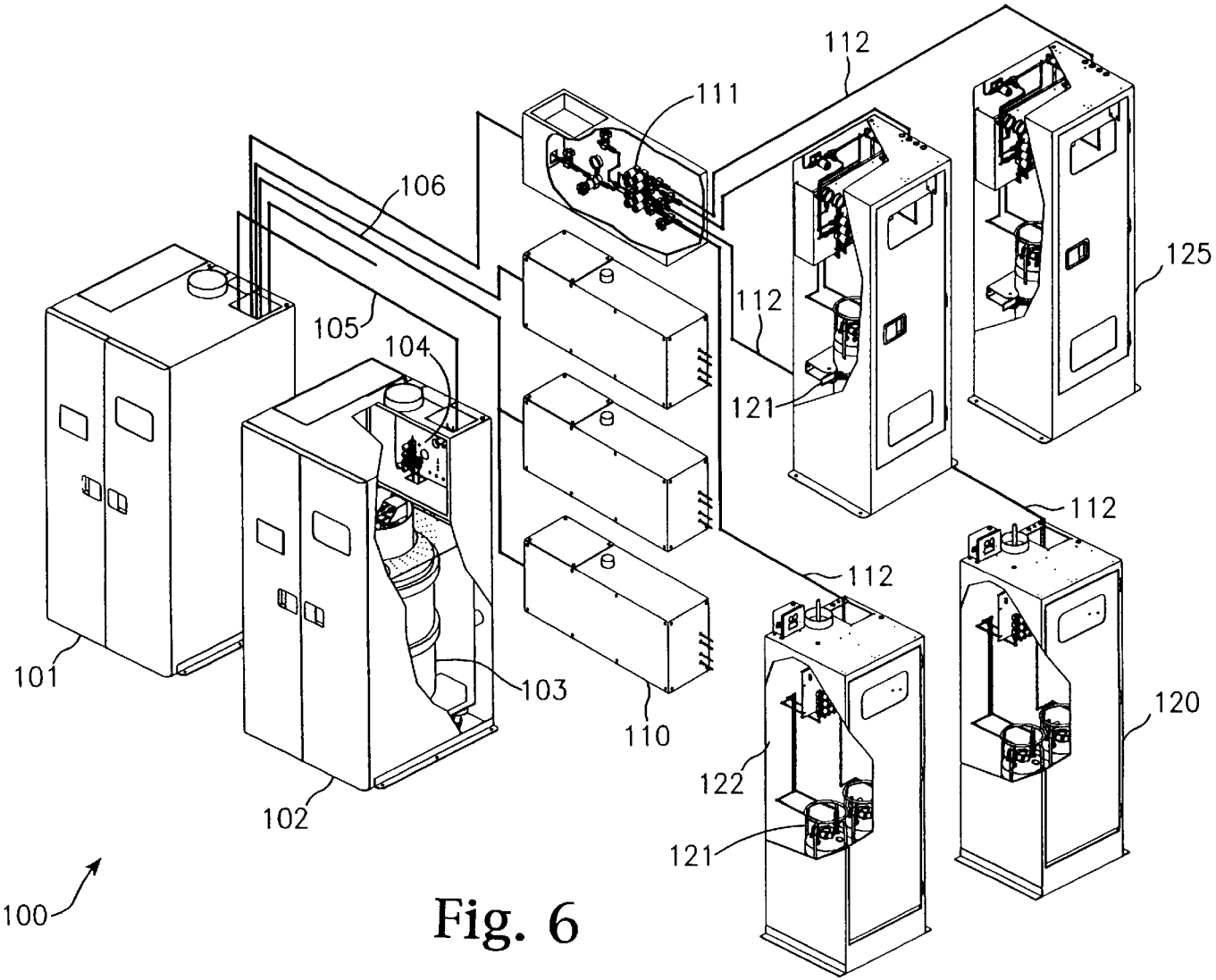
FIG. 6 depicts a representative bulk chemical delivery system that may be used in the practice of this invention.

The baffled cabinets of this invention may also be used in the chemical delivery system 100 as shown in FIG. 6. The system includes at least one bulk canister cabinet 101 which houses a bulk canister, not shown, that supplies chemical to the secondary (intermediate) cabinets either directly or indirectly through manifold boxes 110, and ultimately to the process tool which uses the chemical. The system may optionally include a second bulk cabinet 102 that holds, as shown by cutaway view, a second bulk canister 103 which typically has a capacity of about 200 liters or more. The second bulk canister can supply chemical to the valve manifold boxes when the first bulk canister 101 is being replaced, refilled, repaired, or for any other reason. Alternatively, second bulk cabinet 102 may be employed to refill first cabinet 101 during normal operation.

The cabinet 101 or 102 may include a manifold 104 which may be the same or different in each cabinet. Line 105 from the second canister may be connected to the manifold of the first canister in cabinet 101. If second cabinet 102 is used, a switch over capability, such as a switch over manifold, may be employed which allows the system to provide chemical from second cabinet 102 while first cabinet 101 is being replaced or refilled. Switch over to second bulk canister 102 may be automated such as by use of process control instrumentation well known to one of skill in the art, such as is available from various commercial sources, such as Omron, Inc. Alternatively, overall system management may be controlled using a programmable computer control system that manages canister replacement and purge functions and controls and monitors system parameters, such as a MARS™ Control System as described for example in U.S. Pat. Nos. 5,465,766 and 5,711,354. The controller may also administrate a purge sequence and normal run mode. A purge sequence serves to purge the manifold and canister connection lines prior to removal of an expired bulk chemical supply canister or after a new canister is installed. During a run mode, the system will provide chemical to the process tool, which may be initiated after installation of a bulk chemical supply canister. In one respect, the overall system may be controlled by a single controller in the bulk canister cabinet, with or without a controller on the secondary cabinet and the valve manifold box to supply data back to the primary controller. Alternatively, each bulk and secondary cabinet, and each valve manifold box, may be equipped with a separate controller to control the functions thereof.

Figure 7A:
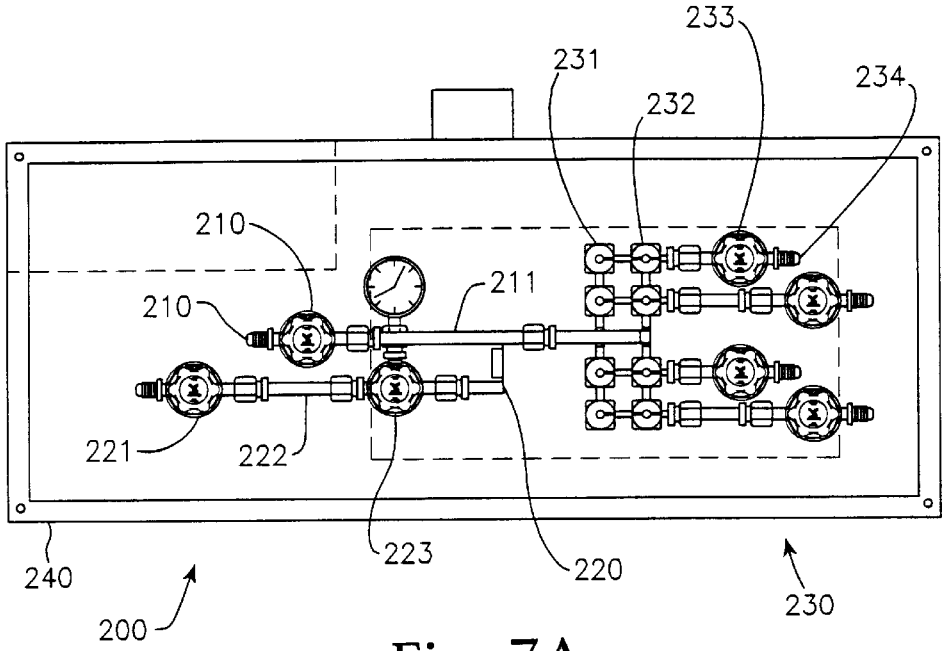
FIGS. 7A, 7B, and 7C illustrate a representative valve manifold box which may be used in this invention.
Figure 7B:
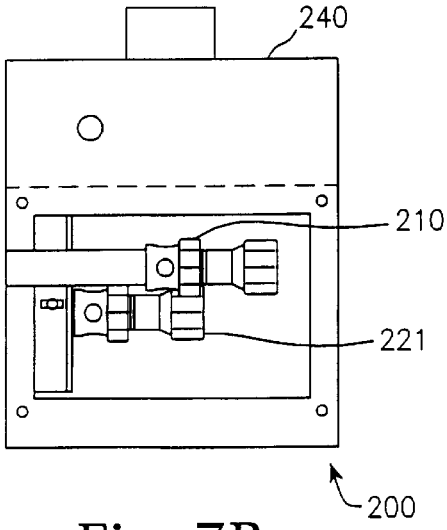
Figure 7C:
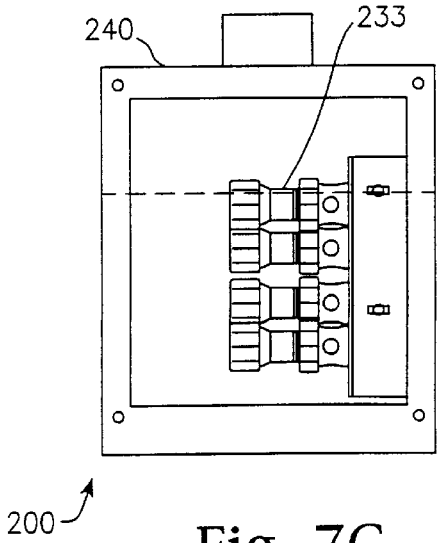
Figure 8A:
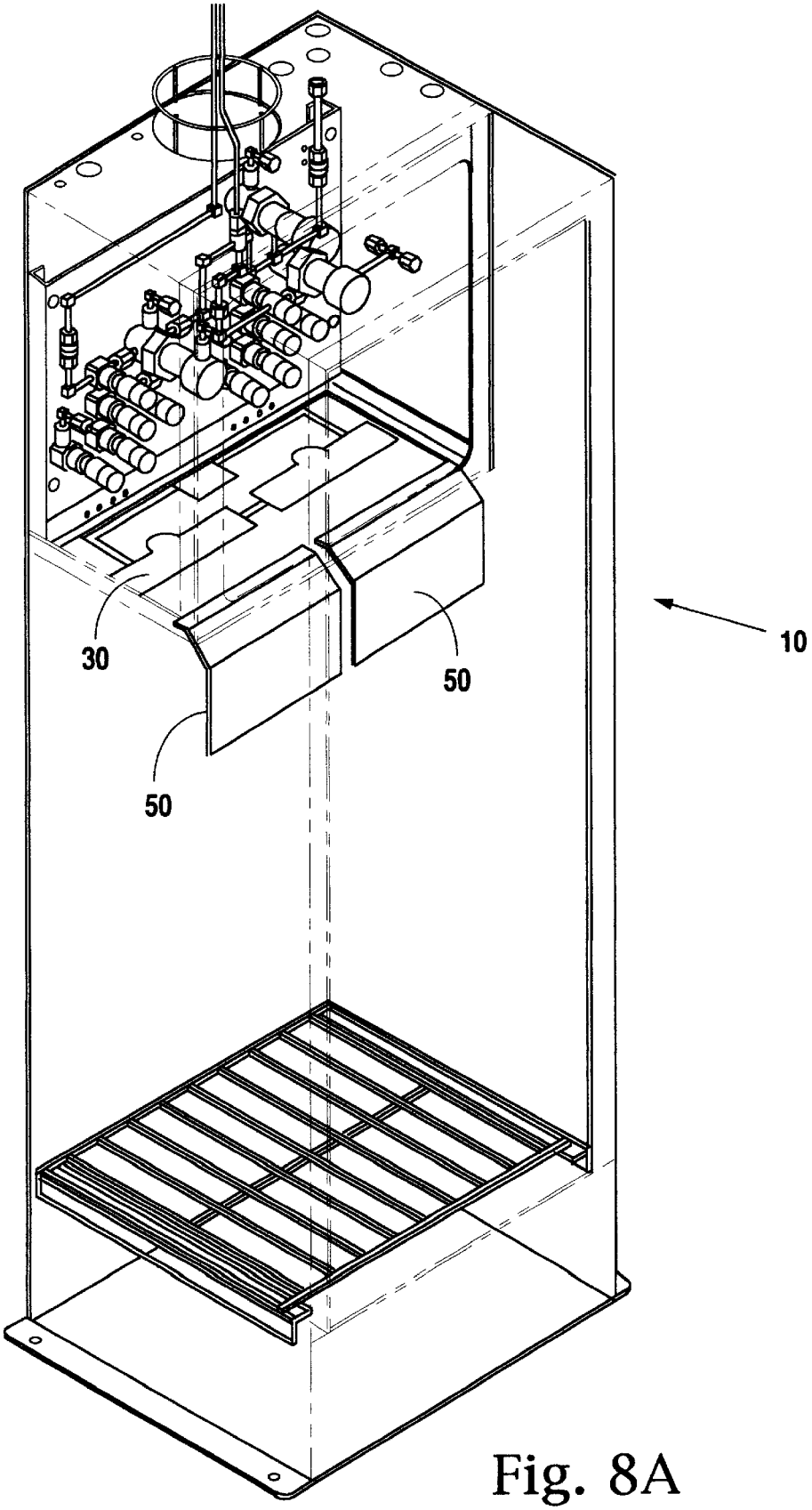
FIGS. 8A–8F illustrate another representative cabinet of this invention.
Figure 8B:
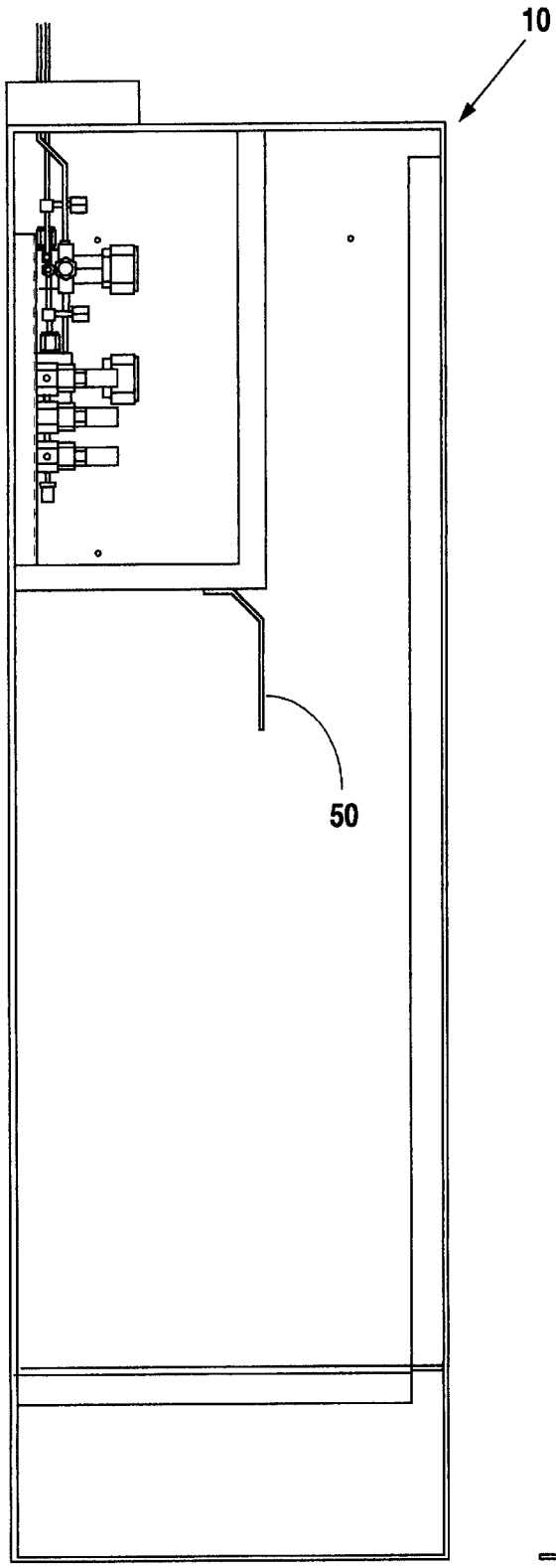
Figure 8D:
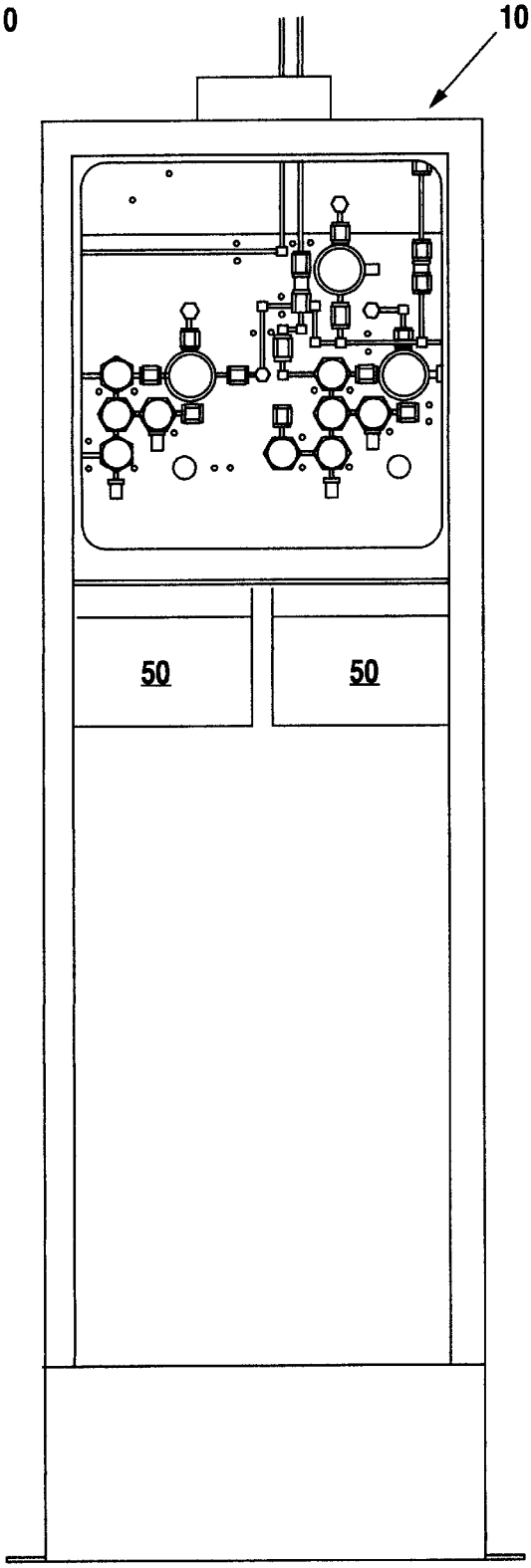
Figure 8C:
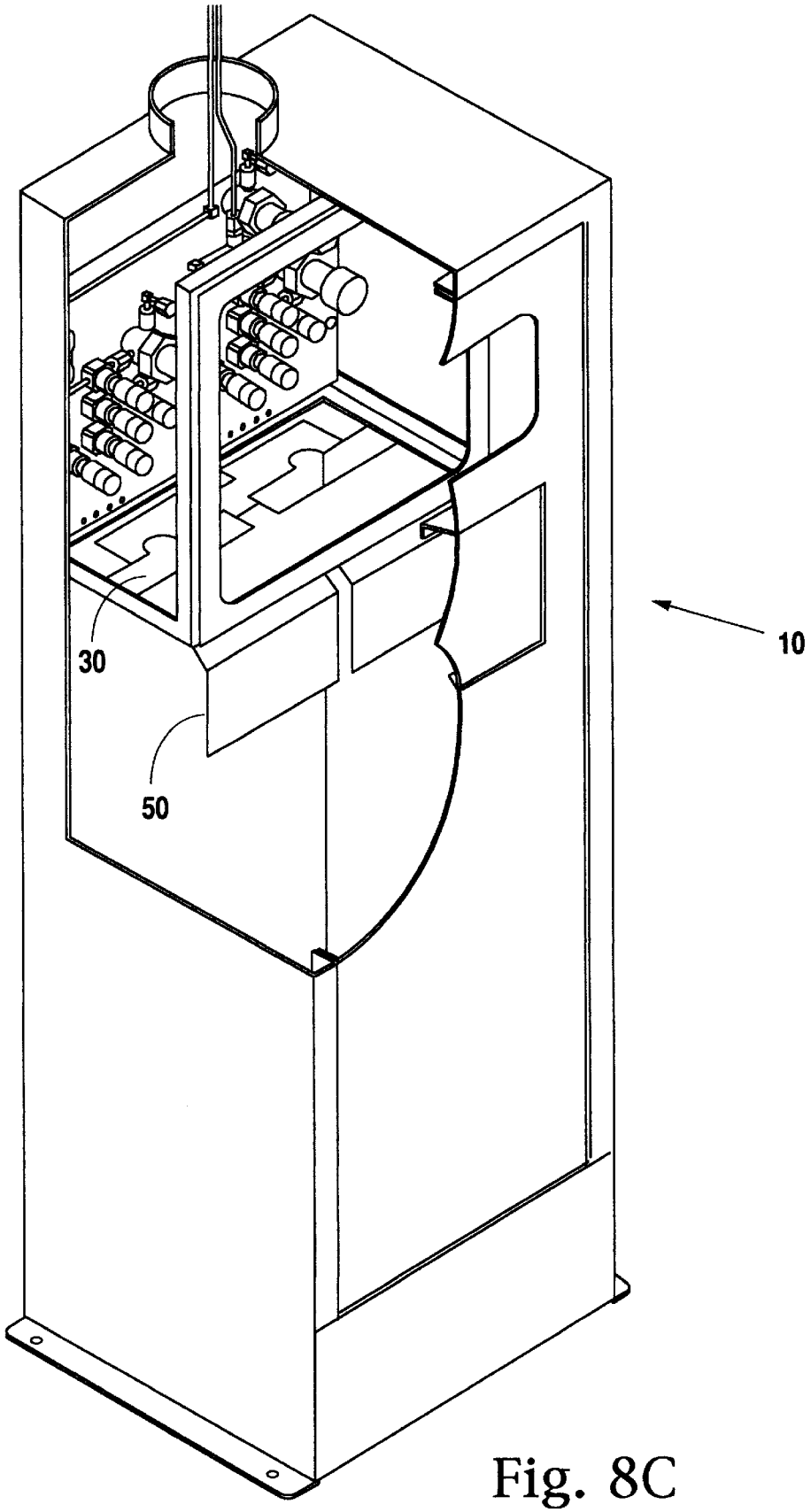
Figure 8E:
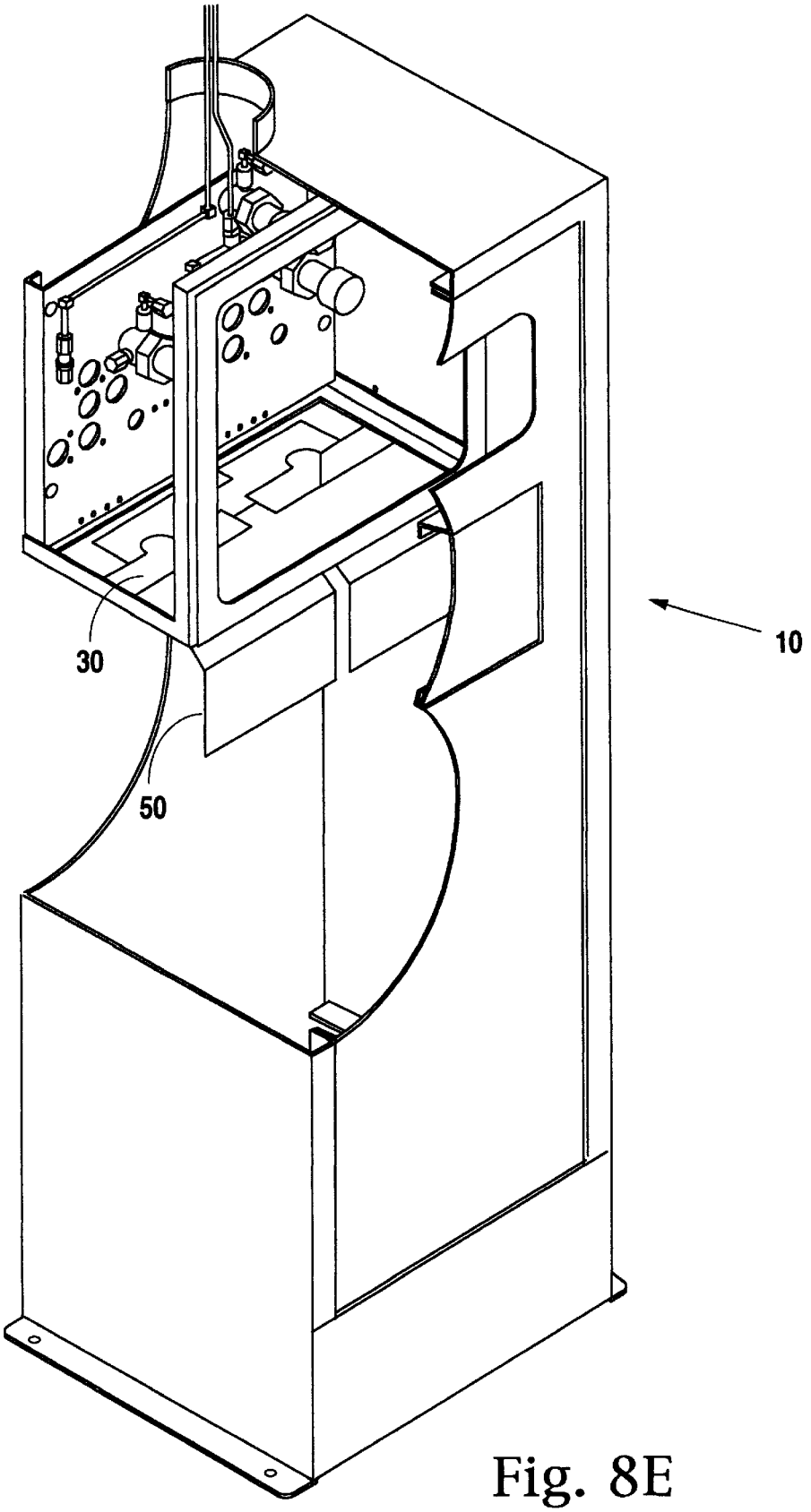
Figure 8F:
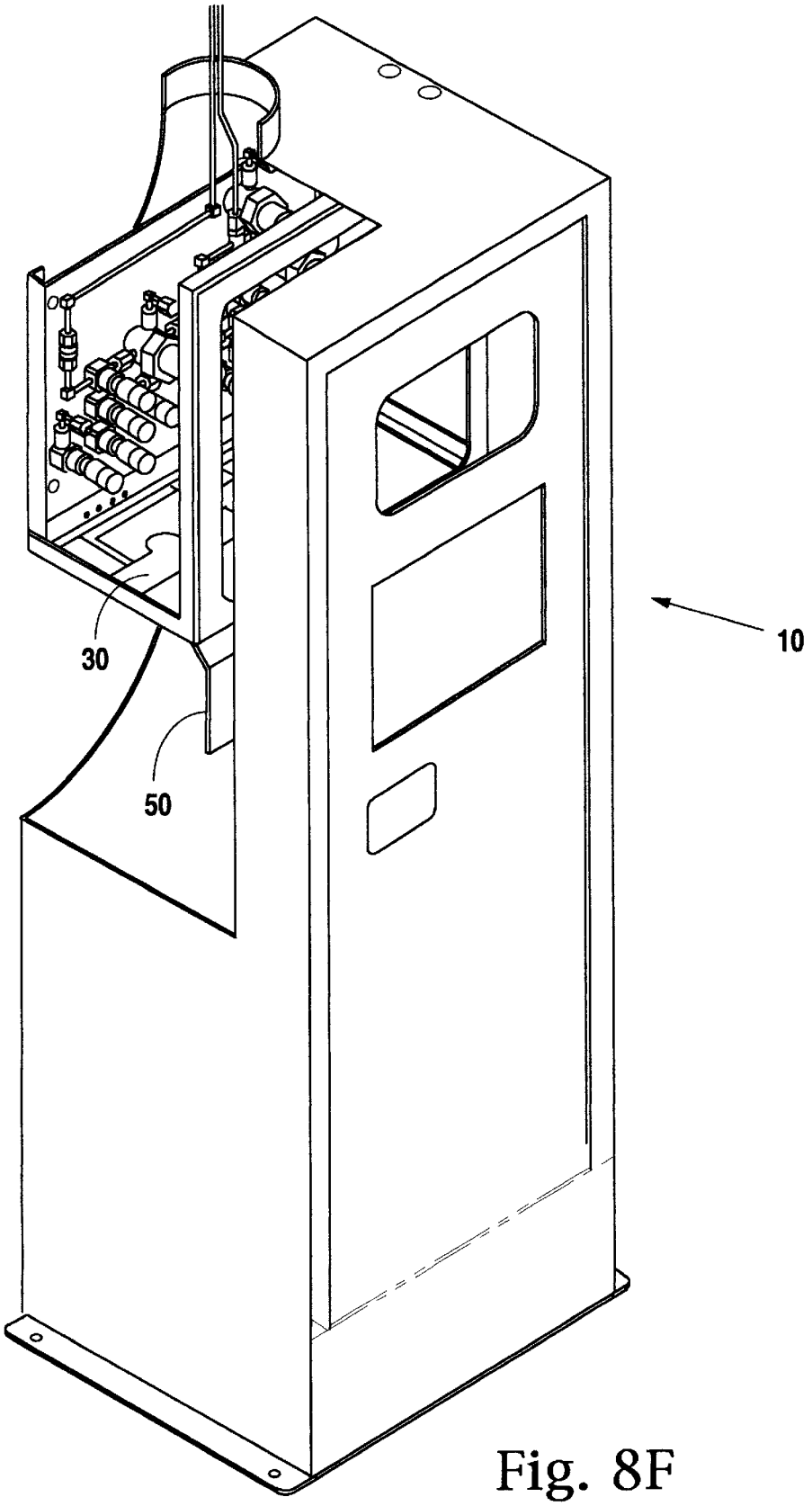

Lines 106 lead from the manifold in cabinet 101 to one or more valve manifold boxes such as valve manifold boxes 110. Any number of valve manifold boxes 110 may be employed. In one embodiment, up to four boxes are used. Each box 110 may contain a manifold 111 such as depicted in FIGS. 7A, 7B, and 7C, discussed herein. The valve manifold boxes 110 serve to split a stream of chemical by a distribution manifold into multiple lines 112 that lead to either a process tool which uses the chemical or to secondary cabinets 120 and 125 which house one or more smaller canisters 121. Each cabinet may contain any desired number of canisters, and one or more canisters may contain a different chemical that may be supplied to a process tool through a separate distribution manifold. In FIG. 6, secondary cabinet 120 houses two smaller canisters 121 while secondary cabinet 125 houses one smaller canister 121. The precise configuration of the manifold in the valve manifold box is not critical in the practice of this invention so long as the function of providing a stream of chemical to the balance of the system and process tool is achieved. The configuration of the valves in the valve manifold box may be varied to allow for serviceability of the components downstream of the valve manifold box and to allow for independent purging and maintenance of individual lines. Optionally, the line from a manifold box 110 to a secondary cabinet 120 may be disconnected and the system designed and programmed to switch over so that a refill canister 121 delivers make up chemical to another canister 121 with the other canister supplying chemical to the process tool. To facilitate change out of the canister 121 designated to primarily deliver chemical to the process tool, the manifold may be designed, and the controller programmed to enable the refill canister 121 to deliver chemical to the process tool. Typically, however, if either the refill or supply canister is being changed out or the like, the system is designed so that chemical from the manifold box 110 switches over to directly feed the process tool. Process tools may alternatively be fed directly from the valve manifold box in the absence of a secondary cabinet. Similarly, in addition to providing chemical to at least one manifold box, the bulk cabinet may also provide chemical directly to one or more process tools. The valve manifold box may include any number of output lines, and typically includes up to four output lines. In FIG. 6, four output lines are employed. The system of FIG. 6 may be used with only one large cabinet or three or more bulk cabinets.

A valve manifold box 200 which may be used in the practice of this invention is depicted in FIGS. 7A, 7B, and 7C. In FIG. 7A, inlet valve 210 receives chemical as from an exit line from the supply manifold of FIG. 6. Inlet valve 210 may be a manual or pneumatic valve or a dual activator valve that would allow full purging of the manifold if there is a need to service the manifold valves. It is contemplated that a valve manifold 110 may optionally receive chemical from multiple sources, such as from two or more bulk canisters. The use of welded connections to the inlet valve and pneumatic activators may enhance the safety considerations relating to spill detection. A line 211 from the inlet valve 210 leads to a group of two or more exit ports, with four exit ports being depicted in FIG. 7A. Line 211 is pressurized by gas, such as helium, from pressure line 220. Pressure line 220 is supplied gas via a source of gas (not shown) which delivers pressurized gas to gas inlet valve 221, thereafter flowing through line 222 and regulator valve 223 which controls the flow into line 220. Pressure line 220 is optional, although typically employed for practicality. The chemical is split in the splitter section 230 of the valve manifold box 200 via two or more pairs of properly ported purge valves 231 and liquid control valves 232. With liquid control valves 232 closed, the valve porting still allows purge gas from purge valve 231 to flow across the top of the seat of liquid control valves 232 and into the exit ports 234 that may couple to an output line that feeds an intermediate cabinet or process tool which may optionally employ an on-board refillable container. This purging allows the purge or draining of liquid in one branch while the others remain on-line. Output valves 233 regulate the output of chemical through each of the output lines. The valve manifold may be contained within housing 240 which may be in the form of a rectangular box made up of six walls. The housing 240 may be made of any suitable material such as sheet metal which is assembled using conventional methods such as by welding or use of suitable fasteners. The front wall may optionally be made of a clear material such as Plexiglas. The housing 240 may include appropriately sized and positioned holes for inlet and outlet lines. In addition, the manifold box may include a liquid sensor and drain outlet from which liquid chemical may be removed that has collected on the bottom of the manifold box. The bottom of the box may be sloped so that a spill may collect in a particular location. The sensor may provide a signal to the controller whereby an operator is alerted, the line to the manifold box is shut down, and so forth.

FIG. 7B is a first side view of the valve manifold box 200. In FIG. 7B, a side view of the inlet side of the valve manifold box, there are removable plates on each end to allow for more flexibility and easier changes to piping and/or connections to the valve manifold box. The removable plate may be a split plate.

FIG. 7C is a second side view of the valve manifold box 200. In FIG. 7C, the outlet side is shown which also uses removal plates and in this case it is a split plate to allow ease of removal to add additional lines while one or more are already in place.

FIGS. 8A–8F illustrate various views of another representative cabinet of this invention. The baffles include holes 30 that serve to direct flow over the manifold. This cabinet also includes splash guards 50 that serve to protect an operator from chemical upon opening the doors to the cabinet.

As used herein, "process tool" refers to a process tool which ultimately uses the chemical provided by the system of this invention. The system of this invention may thus provide chemicals to any process tool which requires a chemical during its use. Such process tools may include apparatuses for chemical vapor deposition, photolithography, and etch applications. These process tools are frequently used in the fabrication of electronic devices such as integrated circuits, memory circuits, flat panel display, possibly fiber optic manufacturing, multichip modules (e.g., "MCMs"), and so forth. In addition, it should be appreciated that while this invention may be used to supply a chemical such as TEOS to a process tool such as a CVD reactor used in the fabrication of integrated circuits, memory devices, and the like, the system may be used in other processes.

The types of chemicals which may be transferred using the bulk delivery system of this invention may vary widely depending on the type of process tool and desired outcome. Nonlimiting examples of representative chemicals include tetraethylorthosilicate ("TEOS"), triethylphosphate, trimethyl phosphite, trimethyl borate, titanium tetrachloride, tantalum compounds, and the like; solvents such as chlorinated hydrocarbons, ketones such as acetone and methylethylketone, esters such as ethyl acetate, hydrocarbons, glycols, ethers, hexamethyldisilazane ("HMDS"), and the like; solid compounds dispersed in a liquid such as barium/strontium/titanate cocktails (mixtures). If the chemical being delivered is solid suspended in an organic liquid, the manifold may be designed so as to allow for liquid flush of all the lines to prevent solids accumulating in the lines upon evaporation of the organic liquid. If dispersions are employed, it is preferable to flush the lines out with liquid solvents such as triglyme or tetrahydrofuran (THF) so that compounds are not precipitated in the lines when the lines are depressurized. These examples of chemicals are not intended to be limiting in any way. The chemicals may be of a variety of purities, and mixtures of chemicals can be used. In one embodiment, a single type of chemical is employed. A given chemical may advantageously have a purity of 99.999% or more with respect to trace metals.

Further modifications and alternative embodiments of this invention will be apparent to those skilled in the art in view of this description. Accordingly, this description is to be construed as illustrative only and is for the purpose of teaching those skilled in the art the manner of carrying out the invention. Equivalent elements may be substituted for those illustrated and described herein, and certain features of the invention may be utilized independently of the use of other features, all as would be apparent to one skilled in the art after having the benefit of this description of the invention.

What is claimed is:

1. A cabinet structure comprising:

rectangular walls connected to a base and a top to provide an enclosed structure;

a valve manifold within the cabinet structure that is attached to a wall;

a baffle structure that encloses the valve manifold;

wherein at least one wall has at least one vent opening on the lower portion thereof;

wherein either the top or a wall includes an exhaust outlet hole;

wherein the baffle structure directs a flow of air over the valve manifold as the air moves from the at least one vent opening to the exhaust outlet hole.

2. The cabinet structure according to claim 1 wherein the structure includes four walls.

3. The cabinet structure according to claim 1 wherein the top includes at least one hole for lines from the canister, cabinet manifold or both.

4. The cabinet structure according to claim 1 wherein one wall is composed of two doors.

5. The cabinet structure according to claim 1 wherein the baffle structure is made of a plastic.

6. The cabinet structure according to claim 1 further comprising a canister connected to the valve manifold in the cabinet via fittings on the canister, and wherein the canister contains a volatile chemical.

7. A cabinet useful for holding a canister, comprising:

an enclosure adapted to house a canister that has fittings attached thereto, a valve manifold that is within and attached to the cabinet structure;

one or more baffles attached to the inside of the enclosure that encloses the valve manifold, wherein the enclosure includes at least one vent opening on the lower portion of the enclosure and at least one exhaust hole on the upper portion of the enclosure;

wherein the one or more baffles are adapted to direct a flow of air that enters the enclosure through at least one vent opening over the valve manifold in the enclosure.

8. A method of increasing the flow of gas through at least a portion of a chemical supply cabinet, comprising:

providing a cabinet structure comprising:

rectangular walls connected to a base and a top to provide an enclosed structure;

wherein at least one wall has at least one vent opening on the lower portion thereof;

wherein either the top or a wall includes an exhaust outlet hole;

providing a baffle structure that together with three walls and the top encloses the valve manifold, wherein the baffle structure has at least one hole that directs the air that moves from the at least one vent opening to the exhaust outlet hole so that the air flows over the valve manifold.

9. Thc method according to claim 8 wherein the structure includes four walls.

10. The method according to claim 8 wherein the top includes at least one hole for lines from the canister, valve manifold or both.

11. The method according to claim 8 wherein one wall is composed of two doors.

12. The method according to claim 8 wherein the baffle structure is made of a plastic.

13. The method according to claim 8 further comprising a canister connected to the valve manifold in the cabinet via fittings on the canister, and wherein the canister contains a volatile chemical.

* * * * *